United States Patent [19]

Ishikawa et al.

[11] Patent Number: 4,726,524

[45] Date of Patent: Feb. 23, 1988

[54] ULTRASONIC ATOMIZING VIBRATORY ELEMENT HAVING A MULTI-STEPPED EDGED PORTION

[75] Inventors: Kiyoe Ishikawa; Hiromi Nakamura, both of Saitama, Japan

[73] Assignee: Toa Nenryo Kogyo Kabushiki Kaisha, Tokyo, Japan

[21] Appl. No.: 861,479

[22] Filed: May 9, 1986

[30] Foreign Application Priority Data

May 13, 1985 [JP] Japan ..... 60-100937

[51] Int. Cl.[4] ..... B05B 17/06; F02M 61/04; F23D 11/34

[52] U.S. Cl. ..... 239/102.2; 239/500

[58] Field of Search ..... 239/102.1, 4, 102.2, 239/101, 500, 501, 533.12, 590.5, 380, 460; 261/DIG. 48

[56] References Cited

U.S. PATENT DOCUMENTS

| | | | |
|---|---|---|---|
| 578,461 | 3/1897 | Mertz | 239/498 |
| 1,659,538 | 2/1928 | Angrove . | |
| 1,730,664 | 10/1929 | Kruse | 239/590.5 |
| 1,758,119 | 5/1930 | Le Moon | 239/460 X |
| 2,596,341 | 5/1952 | McCreery et al. | 239/590.5 |
| 2,712,962 | 7/1955 | Goddard | 239/500 X |
| 3,110,444 | 11/1963 | Eakins | 239/500 |
| 3,317,139 | 5/1967 | Freeland | 447/634 |
| 3,373,752 | 3/1968 | Inoue | 239/4 |
| 3,749,318 | 7/1973 | Cottell | 239/102 |
| 3,756,575 | 9/1973 | Cottell | 261/1 |
| 4,197,997 | 4/1980 | Wu et al. | 239/102 |
| 4,350,302 | 9/1982 | Gruber et al. | 239/500 |
| 4,372,491 | 2/1983 | Fishgal | 239/102 |
| 4,403,741 | 9/1983 | Moriya et al. | 239/585 |
| 4,408,722 | 10/1983 | Freland | 239/533.12 |
| 4,474,326 | 10/1984 | Takahashi | 239/102 |
| 4,496,101 | 1/1985 | Northman | 239/102 |
| 4,501,406 | 2/1985 | Walther et al. | 251/30 |
| 4,541,564 | 9/1985 | Berger et al. | 239/102 |

FOREIGN PATENT DOCUMENTS

| | | | |
|---|---|---|---|
| 0159189 | 10/1985 | European Pat. Off. | 239/102 |
| 861344 | 7/1949 | Fed. Rep. of Germany . | |
| 2239408 | 2/1974 | Fed. Rep. of Germany | 313/239 |
| 786492 | 9/1935 | France | 239/498 |
| 197801 | 1/1978 | U.S.S.R. | 239/501 |

*Primary Examiner*—Andres Kashnikow

*Attorney, Agent, or Firm*—Seidel, Gonda, Goldhammer & Abbott

[57] ABSTRACT

The present invention consists of an ultrasonic atomizing vibratory element having a multi-stepped edged portion formed around the outer periphery thereof. The edged portion has at least two steps each defining an edge and being adapted to be supplied with liquid to be atomized. The vibratory element is provided with a liquid supply groove extending generally longitudinally to supply the liquid to the edge portion in a consistent and stable manner.

1 Claim, 5 Drawing Figures

ULTRASONIC ATOMIZING VIBRATORY ELEMENT HAVING A MULTI-STEPPED EDGED PORTION

TECHNICAL FIELD

This invention relates generally to an ultrasonic atomizing apparatus, and particularly to a vibrating element for use with an ultrasonic atomizing apparatus for atomizing liquid either intermittently or continuously. Such vibrating element may be effectively used with (1) automobile fuel injection valves such as electronically controlled gasoline injection valves and electronically controlled diesel injection valves, (2) gas turbine fuel nozzles, (3) burners for use on industrial, commercial and domestic boilers, heating furnaces and stoves, (4) industrial liquid atomizers such as drying atomizers for drying liquid materials such as foods, medicines, agricultural chemicals, fertilizers and the like, spray heads for controlling temperature and humidity, atomizers for calcining powders (pelletizing ceramics), spray coaters and reaction promoting devices, and (5) liquid atomizers for uses other than industrial ones, such as spreaders for agricultural chemicals and antiseptic solution.

BACKGROUND ART

Pressure atomizing burners or liquid spray heads have been heretofore used to atomize liquid in the various fields of art as mentioned above. The term "liquid" herein used is intended to mean not only liquid but also various liquid materials such as solution, suspension and the like. Injection nozzles used on such spray burners and liquid atomizers are adapted to atomize the liquid by virtue of the shearing action between the liquid discharged through the nozzles and the ambient air (atmospheric air). Accordingly, increased pressure under which the liquid was supplied was required to achieve atomization of the liquid, resulting in requiring complicated and large-sized liquid supplying facility such as pumps, piping and the like.

Furthermore, regulation of the flow rate of injection was effected by varying either the pressure under which to deliver supply liquid or the area of the nozzle outlet opening. However, the former method provided poor liquid atomization at a low flow rate (under a low pressure), as a remedy for which air or steam was additionally used on medium or large-sized boilers to aid in atomization of liquid, requiring more and more complicated and enlarged apparatus. On the other hand, the latter method required an extremely intricate construction of nozzle which was troublesome to control and maintain.

In order to overcome the drawbacks to such prior art injection nozzles, attempts have been made to impart ultrasonic waves to liquid material as it is injected out through the jet of the injection nozzle under pressure.

However, the conventional ultrasonic liquid injecting nozzle had so small capacity for spraying that it was unsuitable for use as such injection nozzle as described above which required a large amount of atomized liquid.

As a result of extensive researches and experiments conducted on the ultrasonic liquid atomizing mechanism and the configuration of the ultrasonic vibrating element in an attempt to accomplish atomization of a large amount of liquid, the present inventors have discovered that it is possible to atomize a large quantity of liquid by providing an ultrasonic vibrating element formed at its end with an edged portion along which liquid may be delivered in a film form, and have proposed an ultrasonic injection nozzle based on said concept as disclosed in Japanese Patent Application No. 59-77572.

Such ultrasonic atomizing apparatus will be briefly described with reference to FIG. 4. The apparatus is illustrated in FIG. 4 as a fuel injection valve 10 for use with a gas turbine engine. The valve 10 includes a generally cylindrical elongated valve body 8 having a central bore 6 extending through the center thereof. Disposed extending through the central bore 6 is a vibrating element 1 which includes an upper body portion 1*a*, an elongated cylindrical vibrator shank 1*b* having a diameter smaller than that of the body portion 1*a*, and a transition portion 1*c* connecting the body portion 1*a* and the shank 1*b*. The body portion 1*a* has an enlarged diameter flange 1*d* which is attached to the valve body 8 by a shoulder 12 formed in the upper end of the valve body and an annular vibrator retainer 14 fastened to the upper end face of the valve body by bolts (not shown).

The forward end of the vibrating element 1, that is, the forward end of the shank 1*b* is formed with an edged portion 2 the details of which are shown in FIG. 3. The valve body 8 is formed through its lower portion with one or more supply passages 4 for feeding said edged portion 2 with fuel. The fuel inlet port 16 of the supply passage 4 is fed with liquid fuel through an exterior supply line (not shown) from an external source of fuel (not shown). The flow and flow rate of fuel are controlled by a supply valve (not shown) disposed in the exterior supply line.

With the construction described above, the vibrating element 1 is continuously vibrated by an ultrasonic generator 100 operatively connected to the body portion 1*a*. Liquid fuel is thus supplied through the exterior line, the supply valve and the supply passage 4 to the edged portion 2 where the fuel is atomized and discharged out.

As illustrated in FIG. 3, the edged portion 2 of the prior art vibrating element 1 comprises a plurality of (five in FIG. 3) annular concentric steps having progressively reduced diameters.

More specifically, with the construction described above, as liquid which is fuel in the illustrated example is passed to the edged portion 2, the stream of fuel is severed and atomized at each edge due to the vertical vibrations imparted to the vibrating element 1. Fuel is first partially atomized at the edge A of the first step, and the excess portion of the fuel which has not been handled at the first step edge A is fed further through the second step edge B, third step edge C and so on to be handled thereby. It is to be understood that at a higher flow rate of fuel a larger effective area is required for atomization, requiring a greater number of step edges. At a lower flow rate, however, a smaller number of steps are required before the atomization of fuel is completed. With the vibrating element 1 as described above, the number of steps required will vary with changes in the flow rate so as to insure generally uniform conditions such as the thickness of liquid film at the location of each step where the atomization takes place, resulting in uniform particle size of the droplets being atomized. In addition, the vibrating element of this type accommodates a full range of flow rates usually required for pulverization, so that atomization of various types of liquid material may be accomplished, whether it may be on an intermittent basis or a continuous basis.

The geometry of the edged portion of the vibrating element 1 such as the shape, height (h) and width of each step of the edged portion of the vibrating element shown in FIG. 3 was such that the edge of each step might act to reduce the liquid to a thin film and dam the liquid flow.

However, with the vibrating element 1 having such configuration, it has been found that in some instances an excessively large pool of liquid S may be formed around the vibrating element above the edge A of the first step as shown in FIG. 3, whereby the supply liquid from the supply passage 4 may not consistently be supplied to the edges B, C, D and E of the second to fifth steps with the result that a desired amount of atomization may not be accomplished. Such phenomenon must be avoided by all means in injection valves for continuous combustion or automobiles.

SUMMARY OF THE INVENTION

It is an object of this invention to provide an ultrasonic atomizing vibratory element which is capable of supplying liquid intermittently or continuously.

It is another object of the invention to provide an ultrasonic atomizing vibratory element which is capable of delivering and atomizing or spraying a large quantity of liquid as compared with the conventional injection nozzle and ultrasonic injection nozzle.

It is still another object of the invention to provide an ultrasonic atomizing vibratory element which is capable of accomplishing consistent atomization in that there is no change in the conditions of atomization (flow rate and particle size) depending upon the properties, particularly the viscosity of the supply liquid.

The aforesaid objects may be accomplished by the ultrasonic atomizing vibratory element according to the present invention.

Briefly, the present invention consists in an ultrasonic atomizing vibratory element having a multi-stepped edged portion formed around the outer periphery thereof, said edged portion having one or more steps each defining an edge and being adapted to be supplied with liquid to be atomized, characterized in that said vibratory element is provided with liquid supply groove means extending generally axially to supply the liquid to said edged portion in a consistent and stable manner.

Specific embodiments of the present invention will now be described by way of example and not by way of limitation with reference to the accompanying drawings.

DESCRIPTION OF THE PREFERRED EMBODIMENTS

Figure 1:
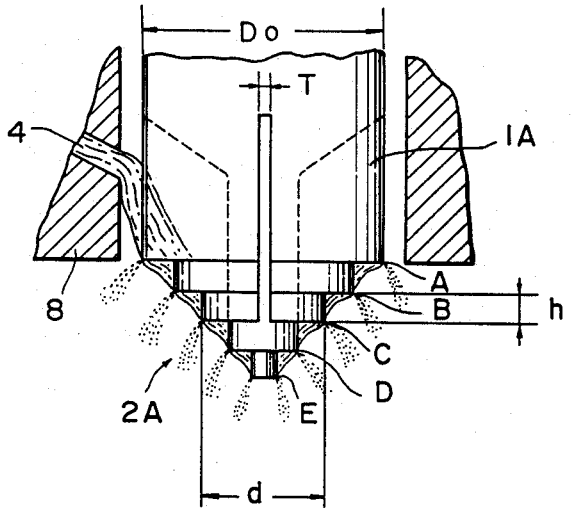
FIG. 1 is a fragmentary front view of one embodiment of the ultrasonic atomizing vibratory element according to this invention.
Figure 2:
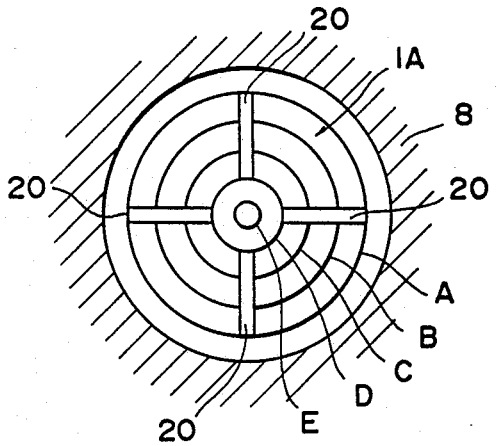
FIG. 2 is a bottom plan view of the vibratory element shown in FIG. 1.

FIGS. 1 and 2 illustrate one embodiment of the ultrasonic atomizing vibratory element according to this invention.

Figure 3:
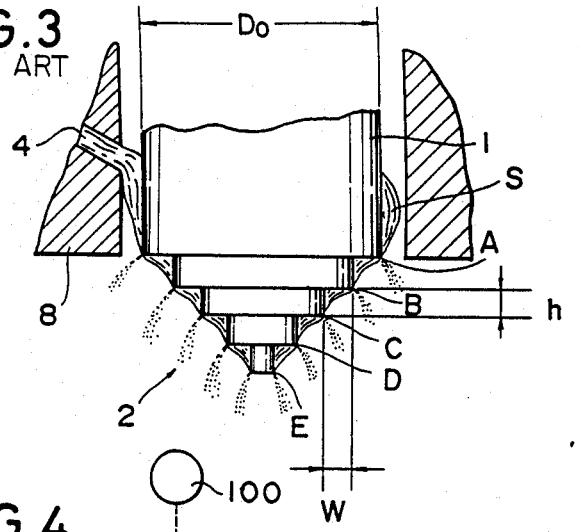
FIG.3 PRIOR ART
FIG. 3 is a fragmentary front view of the edged portion of a prior art vibrating element.
Figure 4:
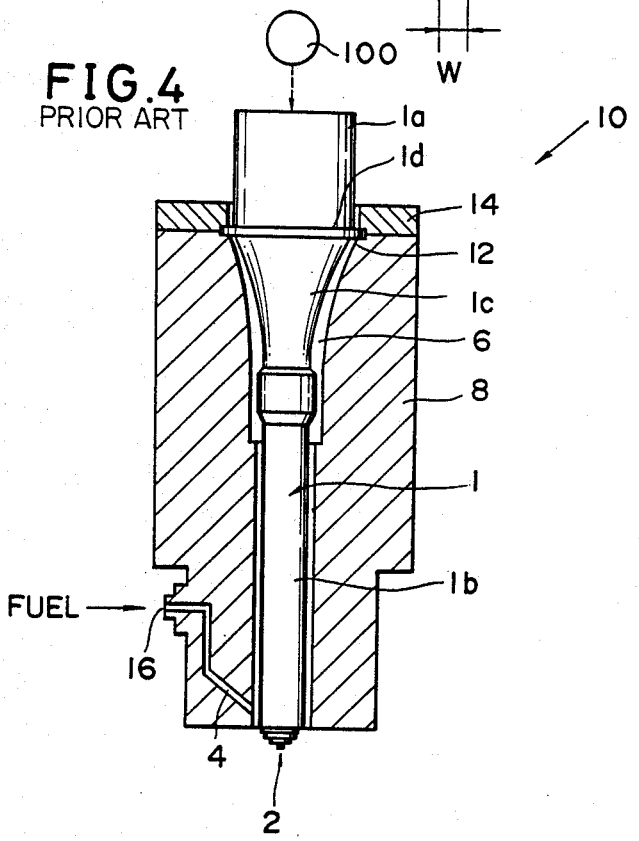
FIG.4 PRIOR ART
FIG. 4 is a schematic cross-sectional view illustrating an ultrasonic injection nozzle equipped with a prior art vibrating element which may be replaced by an ultrasonic atomizing vibratory element according to the present invention.

The vibrating element 1A in this embodiment is similar to the prior art vibrating element 1 shown in FIG. 3 in that it has an edged portion 2A comprising a plurality of (five in the embodiment of FIG. 1) annular steps, but is significantly distinguished in that the element is provided with grooves 20 extending substantially axially from the lower end of the shank portion of the vibrating element to and through the edged portion 2A.

The axial grooves 20 in the illustrated embodiment are shown as extending from the forward end of the shank portion of the vibrating element adjacent the outlets of the respective liquid supply passages 4 through the edges A, B and C to the edge D of the fourth step. This is because the nearer the supply liquid proceeds toward the forward end of the edged portion the more difficult is it for the liquid to be supplied to the edged portion. Of course, the axial grooves 20 may extend to the edge of the other step such as the fifth step edge E, or the second step or third step edge B or C.

While four axial grooves 20 are provided in circumferentially spaced relation in the illustrated embodiment, the number of the grooves may be increased or reduced as required. In addition while all of the four grooves 20 are shown as terminating in the edge D of the fourth step, the grooves may terminate in the edges of different steps.

Figure 5:
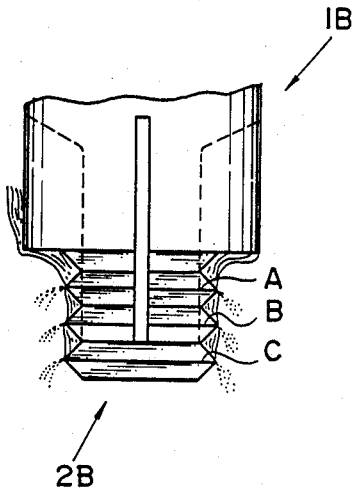
FIG. 5 is a fragmentary cross-sectional view of an alternate embodiment of the ultrasonic atomizing vibratory element according to this invention.

The vibrating element according to the teaching of this invention is not limited to the configuration as illustrated in FIG. 1 but may be embodied as a vibrating element 1B shown in FIG. 5 having an edged portion 1A comprising one or more steps defining annular edges A, B and C of equal diameter. In a further alternate embodiment the vibrating element may have an edged portion (not shown) comprising stepped edges having progressively reduced diameters, as opposed to the edged portion 2A shown in FIG. 1.

An actual example of various parameters and dimensions applicable to the ultrasonic injection atomizing apparatus utilizing a vibrating element as described above according to this invention is as follows: It has been found that such apparatus is capable of providing a large capacity for atomization.

| | | |
|---|---|---|
| Output of ultrasonic vibration generating means: | 10 watts | |
| Amplitude of vibrating element: | 34 μm | |
| Frequency of vibration: | 38 KHz | |
| Geometry of vibrating element (shown in FIG. 1) | | |
| Diameter d of the edged portion | | |
| First step: | Diameter Do | 7 mm |
| Second step: | | 6 mm |
| Third step: | | 5 mm |
| Fourth step: | | 4 mm |
| Fifth step: | | 2 mm |
| Height of each step: | | 2 mm |
| Width T of the axial groove: | | 1 mm |
| Type of fuel: | Kerosine | |
| Flow rate of fuel: | 10 $cm^3/S$ | |
| Injection pressure: | 5 $kg/cm^2$ | |
| Temperature of fuel: | Normal temperature | |
| Material for vibrating element: | Titanium | |

Effects of the Invention

As explained hereinabove, it is to be appreciated that the ultrasonic atomizing vibratory element having substantially axially extending groove means according to this invention provides for supplying liquid to the edged portion in a stable manner, and provides a large capacity for stable atomization with no substantial changes in the atomization conditions such as flow rate and particle size depending on the properties, particularly the viscosity of supply liquid.

We claim:

1. In an ultrasonic atomizing vibratory element having a multi-stepped edged portion formed around the outer periphery of the element, said edged portion having at least two steps each defining an edge and adapted to be supplied with liquid, each said edge severing and atomizing said liquid, the improvement comprising said vibratory element being provided with liquid supply groove means extending substantially longitudinally and across at least one said step thereby supplying the liquid to said edged portion in a consistent and stable manner.

* * * * *